United States Patent [19]

Merry

[11] Patent Number: 5,038,425

[45] Date of Patent: Aug. 13, 1991

[54] PATIENT CHAIR SUSPENSION ASSEMBLY

[75] Inventor: Donald D. Merry, Fenton, Mich.

[73] Assignee: Anodyne Corporation, Brighton, Mich.

[21] Appl. No.: 581,920

[22] Filed: Sep. 13, 1990

[51] Int. Cl.[5] ..... A61G 7/10

[52] U.S. Cl. ..... 5/83; 5/86; 5/87; 5/89

[58] Field of Search ..... 5/81 R, 83, 85, 86, 5/87, 89; 297/277, 280

[56] References Cited

U.S. PATENT DOCUMENTS

| | | | |
|---|---|---|---|
| 319,283 | 6/1885 | Marsh | 5/85 |
| 787,760 | 4/1905 | Higgins | 5/88 |
| 953,591 | 3/1910 | Bringham | 297/280 X |
| 1,977,944 | 10/1944 | Haskett | 5/89 X |
| 2,272,778 | 2/1942 | Reuter | 5/85 |
| 2,368,390 | 1/1945 | Winter | 5/86 |
| 4,202,064 | 5/1980 | Joergensen | 5/83 |
| 4,243,147 | 1/1981 | Twitchell et al. | 5/89 X |
| 4,372,452 | 2/1983 | McCord | 5/85 X |
| 4,387,473 | 6/1983 | Gettner | 5/81 B |
| 4,627,119 | 12/1986 | Hachey et al. | 5/83 |
| 4,748,701 | 6/1988 | Marlowe et al. | 5/89 |
| 4,944,056 | 7/1990 | Schroeder et al. | 5/83 X |

*Primary Examiner*—Michael F. Trettel

*Attorney, Agent, or Firm*—Reising, Ethington, Barnard, Perry & Milton

[57] ABSTRACT

A patient chair suspension assembly (10) for raising and lowering a patient from a bed and for moving the patient to other locations. The patient chair suspension assembly (10) includes rigid back (30), seat (40) and leg (50) portions hingedly attached together. The chair portions (30,40,50) are suspended by a suspension assembly (12) which attaches to a support structure. The patient chair suspension assembly (10) is characterized by suspending support means (12) for attaching to each of the chair portions (30,40,50) and supporting the chair portions in a reclining position while the chair portions are suspended.

31 Claims, 6 Drawing Sheets

FIG - 2
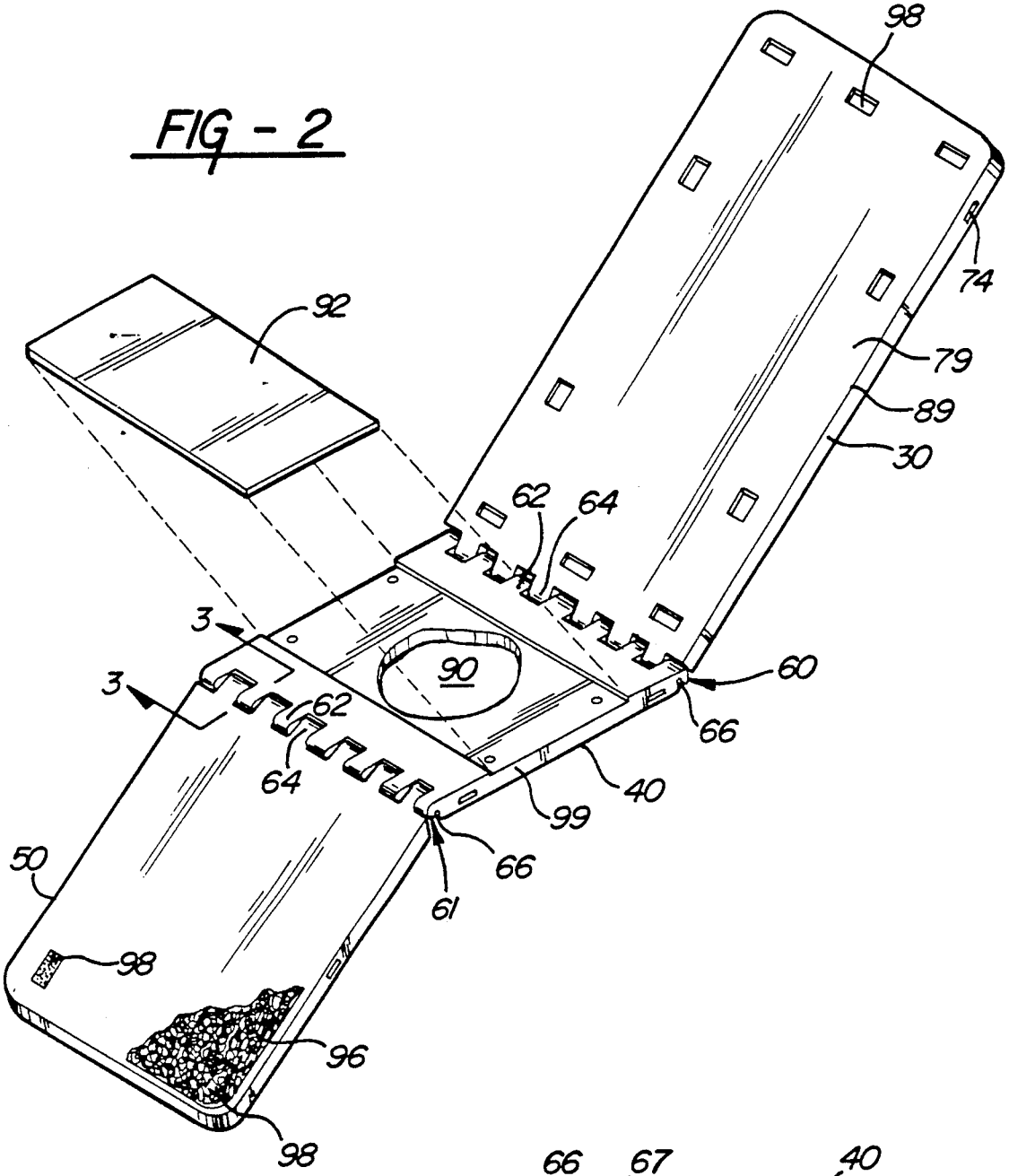
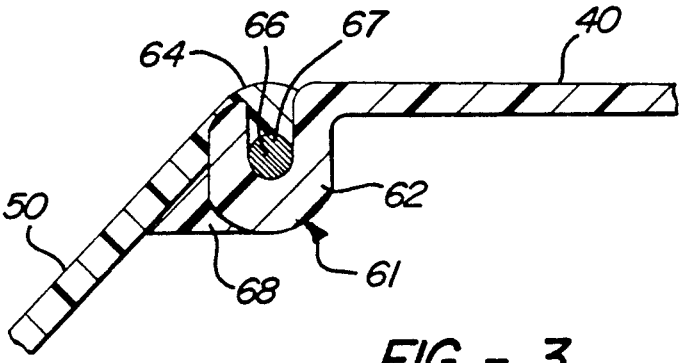
FIG - 3

FIG - 9
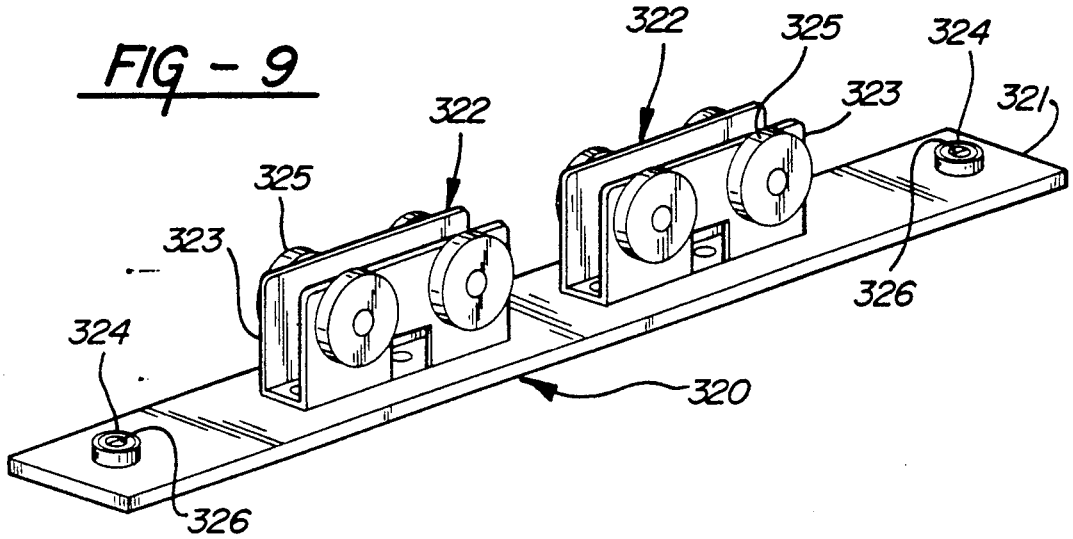
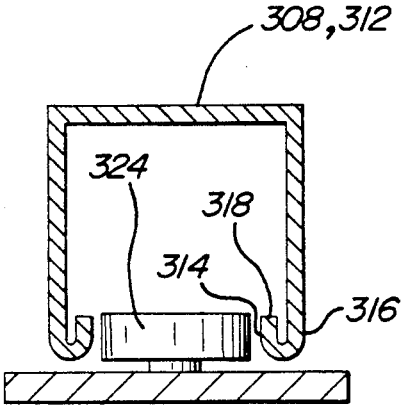
FIG - 10
FIG - 11
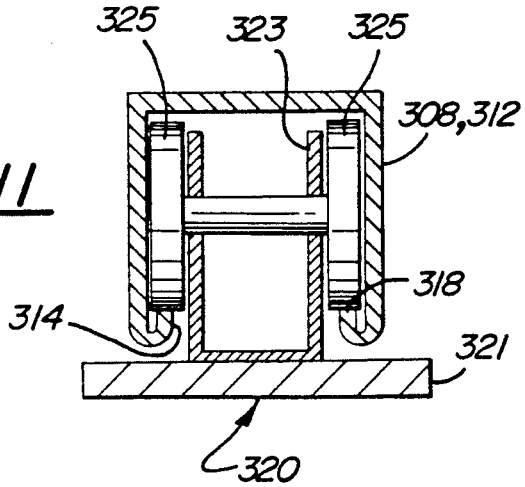

PATIENT CHAIR SUSPENSION ASSEMBLY

TECHNICAL FIELD

The subject invention relates to hospital patient chair suspension assemblies of the type used for supporting a patient during the raising, lowering and transporting of the patient to and from a hospital bed.

BACKGROUND ART

The handling of immobile patients is a major concern in the health care industry. Patients need to be moved from their beds to various places around their rooms and around the surrounding building, including hospital wheelchairs, tubs, toilets.

Designers of patient handling assemblies need to concern themselves not only with the safety and comfort of the patients, but also with the safety and well being of the medical personnel who move the patients. Patient seats must support the patients in safe, comfortable positions during transportation, and account for patient appurtenances such as catheters or hoses or bags. Patient handing systems must also reduce the effort required of the person assisting the transportation of the patient. Unfortunately, a large percentage of all back injuries occur in hospital personnel who attempt to move immobile patients This is often because persons not capable of lifting engage in moving patients from bed to various places. U.S. Pat. No. 4,748,701 to Marlowe et al. and U.S Pat. No. 2,272,778 to Reuter teach lifting a patient in a sling. This is an inexpensive and sometimes useful means for moving a patient around. However, because such slings collapse, they do not adequately support the patient during lifting. Patient appurtenances such as colostomy bags can be crushed against the patient. Also, stitches can be torn if the patient is jostled in a sling. In some cases, the patients legs dangle, possibly causing difficulty in moving the patient.

U.S. Pat. No. 4,387,473 to Gettner teaches a patient lifter with more support for the patient. Its rigid panels hingedly connect together and eliminate some of the problems created by using slings. However, the Gettner '473 patent discloses means for supporting the chair in predetermined positions which is unnecessarily complex, unadapting, and cumbersome. The chair support bracket and related assemblies for supporting the chair in a given position render the chair difficult if not impossible for performing such routine functions as moving the patient from a bed to a wheelchair, tub or toilet. If the assisting person needs to exert extra effort to move the patient somewhere or in some fashion which the chair assembly prohibits, the potential is created for some straining injury to the assisting person.

SUMMARY OF THE INVENTION AND ADVANTAGES

A patient chair suspension assembly for integrally supporting the back, buttocks and legs of a patient during suspension of the patient is disclosed. The patient chair suspension assembly comprises: a rigid back portion having a length and a width; a rigid seat portion having a length and a width, with the seat portion hingedly connected with a hinge to the back portion; a rigid leg portion having a length and width with the leg portion hingedly connected with a hinge to the seat portion. The chair portions are moveable relative to one another between a supine position with the chair portions aligned and plainer, and a reclining position with the leg and seat portions being generally horizontal and the back portion extending upwardly and rearwardly from the seat portion. The patient chair suspension assembly is characterized by suspending support means suspending from a support structure and connected to each of the respective chair portions for supporting the chair portions in the reclining position while the chair portions are suspended.

The resulting chair suspension assembly provides safe and comfortable support for the patient. Because the chair is free of encumbrances, it can easily be moved from a bed to a hospital chair, or to other places where the patient needs to be moved. This reduces strain on the assisting person and the potential for his or her injury. Moreover, because of the relative simplicity of the design, the patient chair suspension assembly is easy and inexpensive to manufacture.

FIGURES IN THE DRAWINGS

Other advantages of the present invention will be readily appreciated as the same becomes better understood by reference to the following detailed description when considered in connection with the accompanying drawings wherein:

FIG. 2 is a perspective view of the chair portions;

FIG. 3 is an enlarged fragmentary side view of the chair portions taken along line 3—3 of FIG. 2.;

FIG. 9 is a perspective view of the trolley which rides in the tracks of the fixed support structure of FIG. 8;

FIG. 10 is a cross sectional view of the track taken along line 10—10 of FIG. 8 showing the roller bearing of the trolley; and FIG. 11 is a cross sectional of the track taken along line 11—11 of FIG. 8 showing the roller car of the trolley.

DETAILED DESCRIPTION OF THE PREFERRED EMBODIMENT

Figure 1:
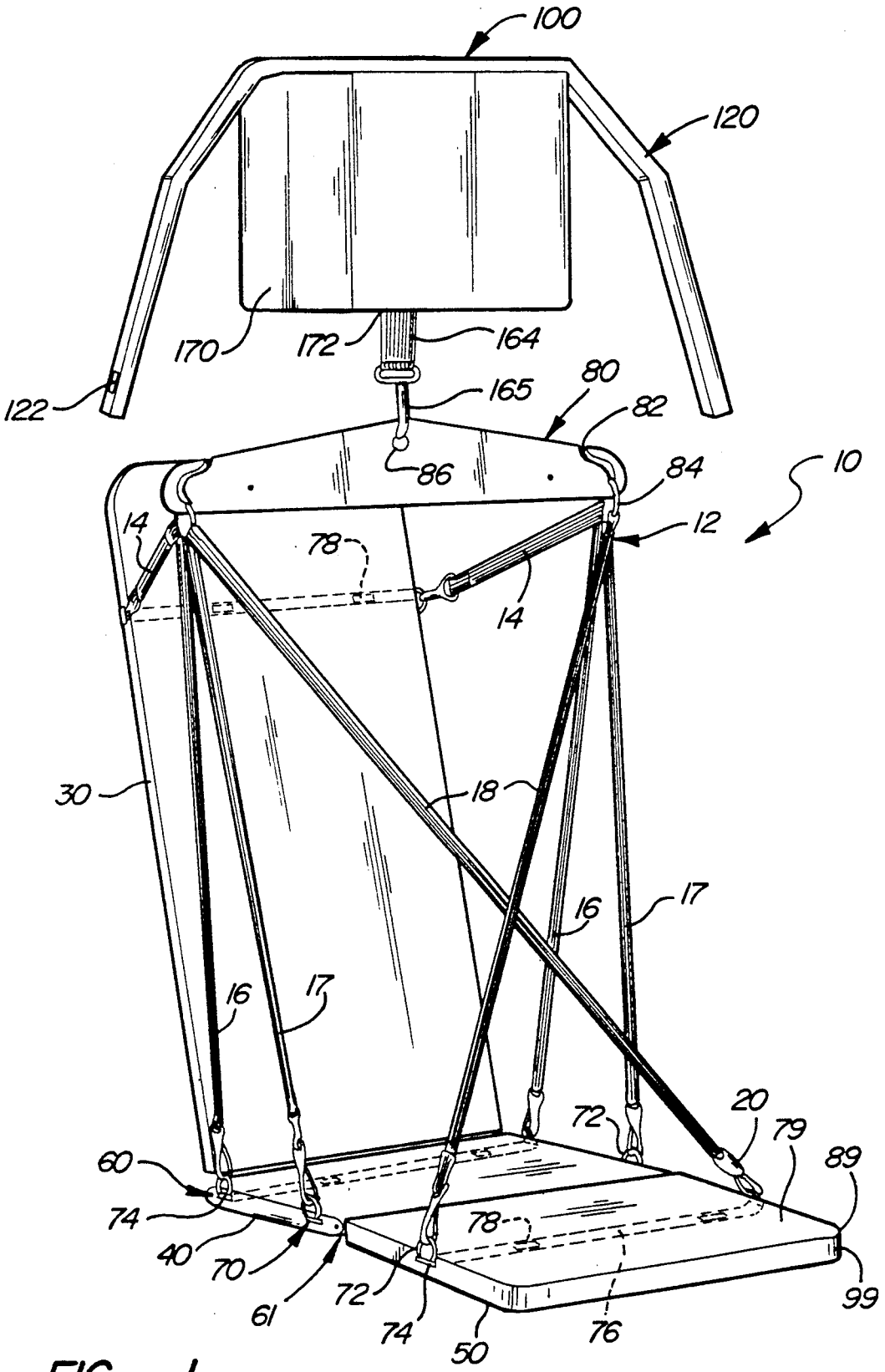
FIG. 1 is a perspective view of the patient chair suspension assembly, the chair stabilizing bar and the hoist assembly.

A patient chair suspension assembly for integrally supporting the back, buttocks and legs of a patient during suspension of the patient is generally shown at 10 in the Figures. The patient chair suspension assembly 10 comprises a rigid back portion 30; a rigid seat portion 40; a rigid leg portion 50 and first and second hinges generally indicated at 60 and 61 for hingedly connecting the seat portions. The patient chair suspension assembly 10 further includes suspending support means generally indicated at 12, a stabilizing bar generally indicated at 80, a hoist generally indicated at 100 and either a portable 200 or a fixed 300 support structure.

The chair portions 30,40,50 each have a length and a width, where the widths of all the chair portions are equal. The chair portions 30,40,50 also include a seating surface 79 defined by an edge 89 and a side surface 99 extending below the edge of the seating surface. Each side surface 99 is perpendicular to the seating surface 79. The chair portions 30,40,50 are generally made from some rigid material, preferably fiberglass. Fiberglass allows the chairs portions 30,40,50 to be immersed in water. It also allows for easy cleanup of the chair portions 30,40,50.

Figure 4:
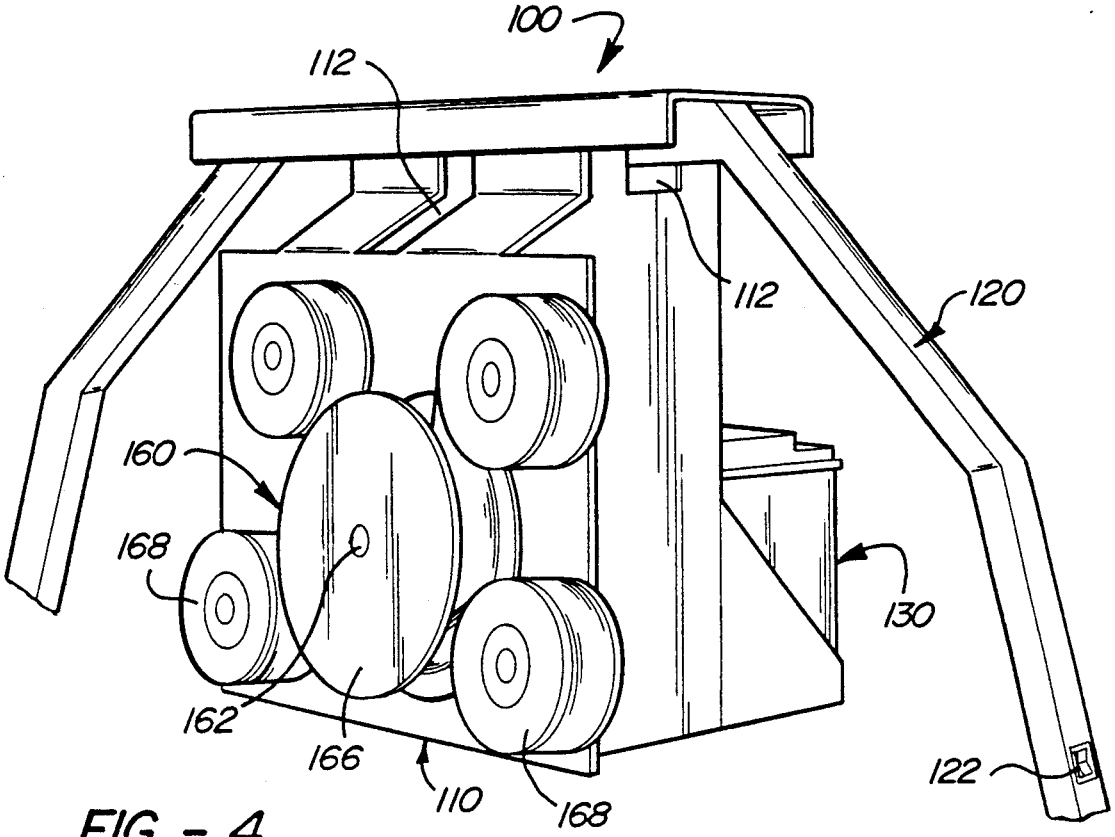
FIG. 4 is a perspective view of the hoist assembly.

The chair portions 30,40,50 are aligned to form a single unit having a length equal to the sum of the lengths of the three portions. The seat portion 40 attaches to both the leg portion 50 and to the back portion 30 by means of first and second hinges 60 and 61. The first hinge 60 is disposed between the back portion 30 and the seat portion 40. The second hinge 61 is disposed between the seat portion 40 and the leg portion 50. The hinges 60 and 61 are integral piano hinges formed as part of the chair portions 30,40,50. The seat portion 40 includes the hinge fingers or mating portions 62; the back 30 and the leg 50 portions are formed to include the hinge fingers or mating portions 64. Once the portions 30,40,50 are aligned and the interleaved hinge fingers or mating portions 62 and 64 mate properly, rods 66 pass through the holes 67 formed through the two mated hinge portions 62 and 64, and pivotally interconnect the seat portions 30,40,50 together. Thus, the chair portions 30,40,50 pivot relative to one another about the axes formed by the connecting rods 66. The seat portion 40 is further formed to include stop means 68 as shown in FIG. 4. The stop means 68 is defined as a hinge boss. The stop means 68 prevents the leg portion 50 from rotating about the pin 66 beyond a predetermined point. For example, when the chair portions 30,40,50 are deposited in a wheelchair, the stop means 68 prevents the leg portion from dropping below the plane of the seat portion 40 and interfering with the front wheels of a wheelchair.

But for the stop means 68, the chair portions 30,40,50 are free to rotate with respect to each other about the hinges 60,61. The chair portions may assume a supine position where the chair portions 30,40,50 are aligned and planar. The chair portions 30,40,50 may also assume a reclining position where the leg 50 and seat 40 portions are generally horizontal and the back portion 30 extends upwardly and rearwardly from the seat portion 40.

The patient chair suspension assembly 10 further includes suspending support means 12 suspending from a support structure and connected to each of the respective chair portions 30,40,50 for supporting the chair portions in the reclining position while the chair portions are suspended. The suspending support means 12 generally comprises ties 14,16,17,18 suspending from a support structure. The ties 14,16,17,18 are preferably straps made from woven fibers, though the ties can be cords or chains. The patient chair includes at least three pairs of the suspending ties 14,16,17,18 suspended by their first ends downward under the force of gravity to their second ends from a support structure. The suspending support means 12 specifically includes four tie pairs. All four tie pairs 14,16,17,18 suspend from the same point on the support structure.

The first tie pair 14 suspends from a support structure and attaches to the back portion 30 of the chair. This first tie pair 14 is the shortest of the tie pairs.

Second and third tie pairs 16,17 suspend from a support structure and attach at spaced positions to the seat portion 40. These tie pairs are the next shortest of the tie pairs 14,16,17,18. The second tie pair 16, attached nearest to the back portion 30, is slightly longer than the third tie pair 17. The slight difference in the lengths of the tie pairs 16,17 produces a backward tilt in the seat portion 40. This tilt better secures the patient on the chair portions 30,40,50. The two tie pairs 16,17 may be replaced with one tie pair.

A fourth tie pair 18 suspends from a support structure and attaches to the leg portion 50. This is the longest tie pair. The fourth tie pair 18 should be crossed between the leg portion 50 and the support structure to provide stability for the chair portions 30,40,50 while the chair portions are suspended.

The suspending tie pairs 14,16,17,18 include clips 20 located on the second ends of each of the ties. The clips 20 facilitate attachment to the chair portion 14,16,17,18. These clips are preferably made from metal.

The ties 14,16,17,18 should be attached to the seat portions 30,40,50 in order to minimize or eliminate the hinges 60 and 61 bearing any of the load. If the ties 14,16,17,18 bear most or all of the load borne on the chair portions 30,40,50, the stability of the patient chair suspension assembly 10 will be maximized when the assembly is suspended.

The patient chair suspension assembly 10 further includes chair attachment means generally indicated at 70 located on the side surfaces 99 of the chair portions 30,40,50 for attachment to the tie pairs 14,16,17,18. The chair attachment means generally indicated at 70 may simply include rings 72 extending from the side surfaces 99 of the chair portions 30,40,50. The chair attachment means 70 includes at least four pairs of rings 72 to receive the four pairs of suspending ties 14,16,17,18, where one pair of rings 72 is located on the back portion 30, two pairs of rings 72 are located on the seat portion 40 and one pair of rings 72 is located on the leg portion 50.

The preferred embodiment of the chair attachment means 70 includes slits 74 located on each of the chair portions 30,40,50, a connecting tie 76 and the rings 72. One or two pairs of slits 74 are located on opposite side surfaces 99 of each of the chair portions 30,40,50. A connecting tie 76 having a length equal to the width of the chair portion runs under the seating surface 79 of the given chair portion and through the slits 74 in the side surfaces 99 of the chair portion. The connecting tie 76 is preferably a strap made from woven fibers. The pair of rings 72 fixes on opposite ends of the connecting tie 76 on the side surfaces 99 of the chair portion. The rings 72 are larger than the slit 74, and thus the rings cannot be pulled through the slits 74. The rings 72 are held close to the side surface of the chair portion by the tautness of the connecting tie 76. The connecting tie 76 fixes to the underside of the seating surface 79 of the chair portion with Velcro TM 78, or other suitable hook and loop fasteners.

The suspending support means 12 can be suspended from any suitable support structure. Preferably, the suspending support means 12 is suspended from a stabilizing bar 80, which is itself suspended from a support structure. The stabilizing bar 80 has a first and second end. The stabilizing bar 80 is adapted for suspension from above the bar 80 so that the length of the bar parallels the floor or ground. The stabilizing bar 80 includes means for suspending the suspending tie pairs 14,16,17,18 from the first and second ends of the stabilizing bar. Such means include generally vertical slots 82 located in the first and second ends of the stabilizing bar 80, and metal rings 84 suspending downwardly from the slots 82 for attachment to one of the ties in each of the suspending tie pairs 14,16,17,18. The slots 82 are not strictly vertical; the ideal slot is slightly serpentine in shape. The stabilizing bar 80 itself suspends from a support structure by a hole 86 located in the middle of the length of the stabilizing bar 80.

The preferred embodiment of the assembly 10 includes a commode hole 90 disposed through the seat portion 40. The assembly 10 includes a commode cover 92 fitting over the commode hole 90. The cover 92 may be fiberglass or metal.

The preferred embodiment of the patient chair suspension assembly 10 further includes cushion means 96 for attachment to the seating surfaces 79 of the chair portions 30,40,50. The cushion means 96 is generally a sheep skin fixed to the chair portions 30,40,50 by means of Velcro TM patches 98, or other suitable hook and loop fasteners placed on the seating surfaces 79 of the chair portions 30,40,50.

In operation, the chair portions 30,40,50 are disposed underneath the patient in the hospital bed. The patient is centered on the chair portions 30,40,50, and the chair stabilizing bar 80, with the tie pairs 14,16,17,18 suspended therefrom, is lowered from a hoist far enough from a support structure to connect tie pairs 14, 16 and 17 to the back portion 30 and the seat portion 40, respectively. The clips 20 on the tie pairs 14, 16 and 17 clip on to their corresponding rings 72 on the back 30 and seat 40 portions. The chair stabilizing bar 80 is then raised by the hoist so as to bring the patient into a reclining position. The tie pair 18 is then attached to the leg portion 50. The tie pair 18 is crossed as shown in FIG. 2 to stabilize the chair portions 30,40,50 while suspended. The patient is then lifted off the bed by raising the chair stabilizing bar 80 with the hoist. The patient suspends in a reclining position with legs extended straight out so as not to interfere with the movement of the patient. The patient may be moved wherever the support structure will permit. The chair portions 30,40,50 may be lowered and deposited in a wheel chair, a tub or over a toilet.

The patient chair suspension assembly 10 further includes a hoist generally shown at 100 for raising and lowering the patient chair suspension assembly 10. The hoist 100 may be mounted on or suspended from any support structure. The hoist assembly 100 includes a chassis generally indicated at 110, a handlebar generally indicated at 120, a battery generally indicated at 130, a motor assembly generally indicated at 140, a gear system (not shown), a drum assembly generally indicated at 160 and a housing 170.

A chassis 110 mounts to a support structure. The chassis 110 is generally metal. It may be bolted or welded to a support structure. The remainder of the hoist components mount to or rest on the chassis 110.

A handlebar 120 mounts to the chassis 110 as shown at FIG. 4. The chassis includes handlebar mounting holes 112 for mounting the handlebar 120 to the chassis. The handlebar mounting holes 112 allow the handlebar 120 to be mounted in various positions with respect to the chassis 110.

The handlebar 120 is a hollow piece of metal having a rectangular cross section. The handlebar 120 includes a switch 122 located on either side of the bar for controlling the hoist 100. Because the handlebar 120 is hollow, a hole may be drilled in the handlebar and a wire lead may easily be fed from the switch 122 to other parts of the hoist assembly 100.

Figure 5:
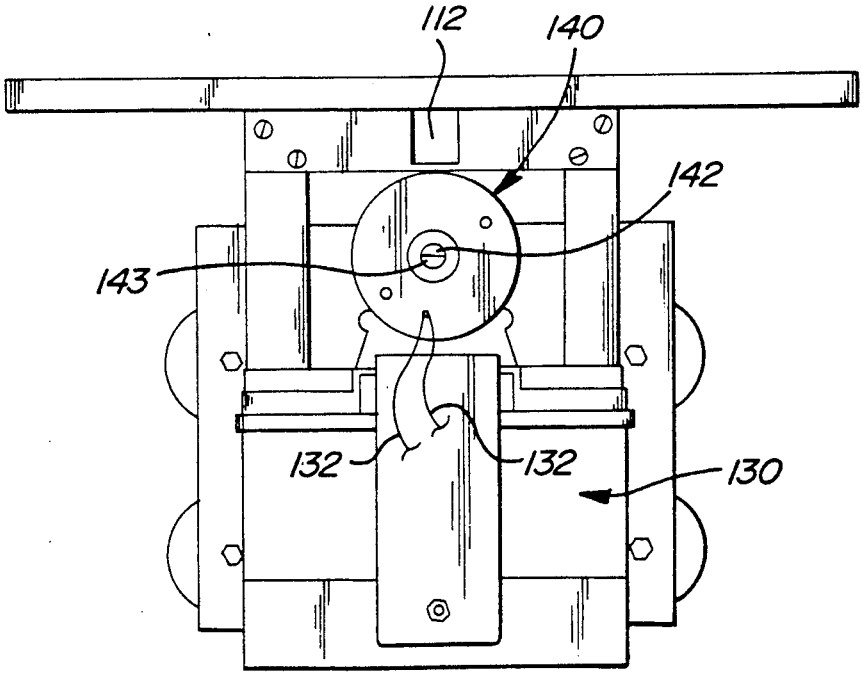
FIG. 5 is a rear view of the hoist assembly showing the battery and motor.

A rechargeable battery 130 mounts on the chassis at 110 as shown in FIGS. 4 and 5. The battery 130 includes wire leads 132 leading from the battery to the motor 140, a relay (not shown) disposed along the wire leads 132 between the battery 130 and the motor 140, a wire lead (not shown) to the switch 122 on the handlebar 120 and a recharge plug (not shown). The battery 130 is a rechargeable 12 volt battery. The battery 130 is preferably a gelcell sealed battery. The relay is included to minimize the loss of the current between the battery 130 and the motor 140. A recharge plug is provided to allow the battery 130 to be recharged from an electric power source.

The motor 140 includes a shaft 142, a flat 143 located on the shaft, a brake (not shown), a limiter (not shown) and a crank (not shown). The shaft 142 extends completely through the motor. A first end of the shaft connects to the gear system. A second end of the shaft connects to the brake, the limiter and the crank. The shaft 142 includes a flat 143 located on the second end of the shaft for connection to the crank. A brake may be mounted on the second end of the shaft 142 for preventing rotation of the shaft when the power to the motor 140 is off. A limiter may also be mounted on the second end of the shaft 142 for preventing the shaft from rotating more than a specified number of times in any one direction—clockwise or counter-clockwise. The crank may be stored separate from the shaft 142 and attached to the shaft 142 at the flat 143 only when power to the motor 140 fails. The motor 140 is mounted to the chassis 110 such that the shaft 142 is horizontal.

The first end of the shaft 142 attaches to a gear system (not shown). The gear system is preferably a planetary gear system for gear reduction between the motor shaft 142 and the drum assembly 160. The gear reduction provided by the gear helps minimize battery drain.

The drum assembly 160 attaches to the planetary gear system 150. The drum assembly 160 includes a cord shaft 162, a cord take-up drum (not shown), a cord 164, a counter balance drum 166 and counter balance springs 168. The cord take-up drum fits concentrically on the shaft 162. The shaft 162 rotates in a horizontal plane about the axis formed by the length of the shaft 162 and is powered by the planetary gear system. The cord 164 extends through the housing 170, has a first end attached to the take-up drum and a second end disposed exterior of the housing for suspending the patient chair suspension assembly 10 and moving the assembly 10 vertically in response to rotation of the drum about the axis of the shaft 162. The cord 164 is preferably a strap made from woven fibers. The cord 164 has a clip 165 attached to its second end for clipping to the load. Also mounted on the shaft 162 is a counter balance drum 166. The counter balance drum 166 is mounted concentrically on the shaft 162. Circular constant force counter balance springs 168 attach to the counter balance drum 166 for exerting a constant torque on the drum as the drum rotates about the axis of the shaft 162 to assist the motor 140 in forceably rotating the take-up drum as the chair assembly 10 is moved vertically. Preferably, four constant force springs 168 are attached to the counter balance drum 166. The four springs 168 are mounted to the chassis 110 as shown in FIG. 4.

The hoist assembly 100 further includes a housing 170. The housing covers the chassis and the components mounted thereto. The housing 170 includes slits 172 for allowing the cord 164 to pass through. The slit 172 is generally located on the bottom of the housing 170 or on the front of the housing near the top of the housing.

In operation, a person may raise or lower the load lifted by the hoist 100 (e.g. a patient resting on the patient chair suspension assembly) by manipulating the switch 122 on the handlebar 120. The motor 140 turns the shaft 142; the shaft 142 powers the planetary gear system; the planetary gear system turns the cord shaft 162, and thus the cord take-up drum. The limiter on the motor shaft 142 prevents the load from being raised above or below predetermined points. The brake 144 prevents the motor shaft 142 from rotating when the power is off, thus preventing a sudden drop of the load. However, in the case of a power failure in the hoist 100, the hand crank can be used to raise or lower the load. The hand crank provides enough torque on the motor shaft 142 to overcome the brake force from the brake.

The counter balance springs 168 support about one hundred pounds of the load. In other words, the springs 168 alone could exert enough torque on the cord shaft 162 to lift one hundred pounds of load—independent of the motor 140. The springs 168 thus diminish the work necessary from the motor 140. This helps conserve battery power.

A portable support structure generally shown at 200 is intended for use in lifting the patient chair suspension assembly 10 from a bed or other position and moving the patient chair suspension assembly 10 around a floor. The portable support structure 200 is small enough to fit through a standard size door. The portable support structure 200 is also wide enough to enclose a hospital wheel chair for the purpose of lowering the chair portions 30, 40,50 into the wheel chair.

The portable support structure 200 includes a frame generally indicated at 210 which is bent or otherwise formed to include a cantilevered portion 220, a truss portion 230, and a base portion 240. The base portion 240 extends horizontally from the vertically extending truss portion 230. The cantilever portion 220 extends horizontally from the top of the truss portion 230 in the same direction as the base portion 240. A hoist bracket 240 and wheels 260 are attached to the frame 210.

The frame 210 comprises two rigid tubes 211 of the same length attached to one another and spaced apart by spacers 216. The tubes 211 may be metal or other suitable material.

Figure 7:
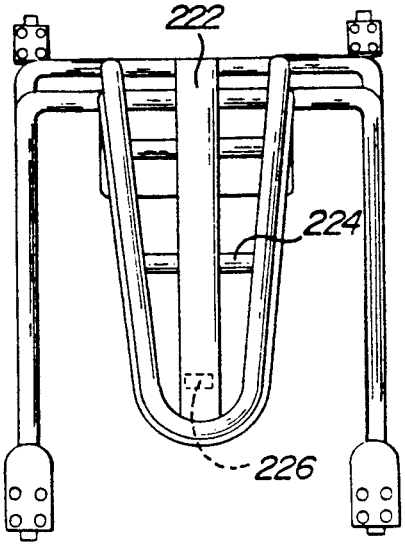
FIG. 7 is a top view of the portable support structure of FIG. 6.
Figure 6:
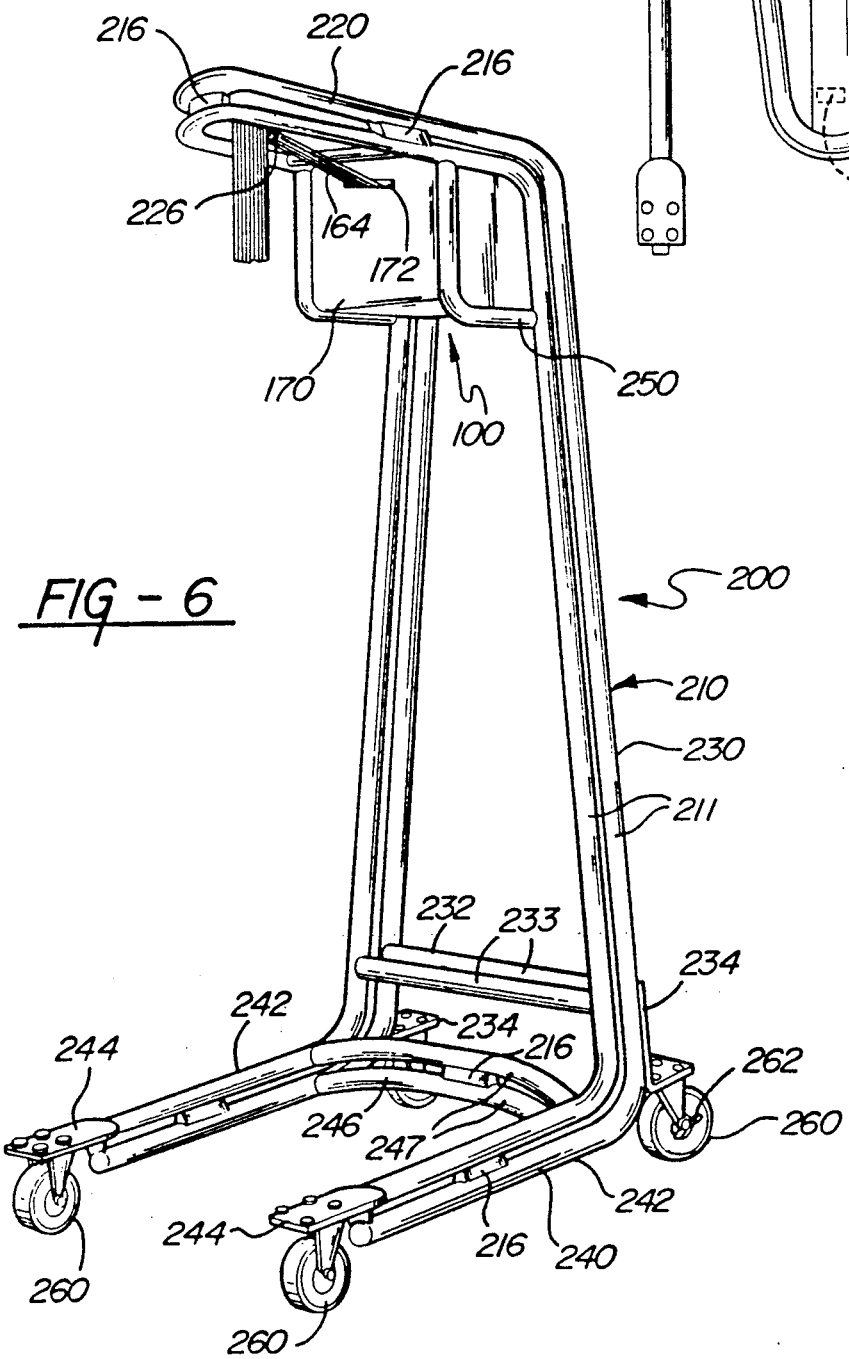
FIG. 6 is a perspective view of the portable support structure including the hoist assembly.
Figure 8:
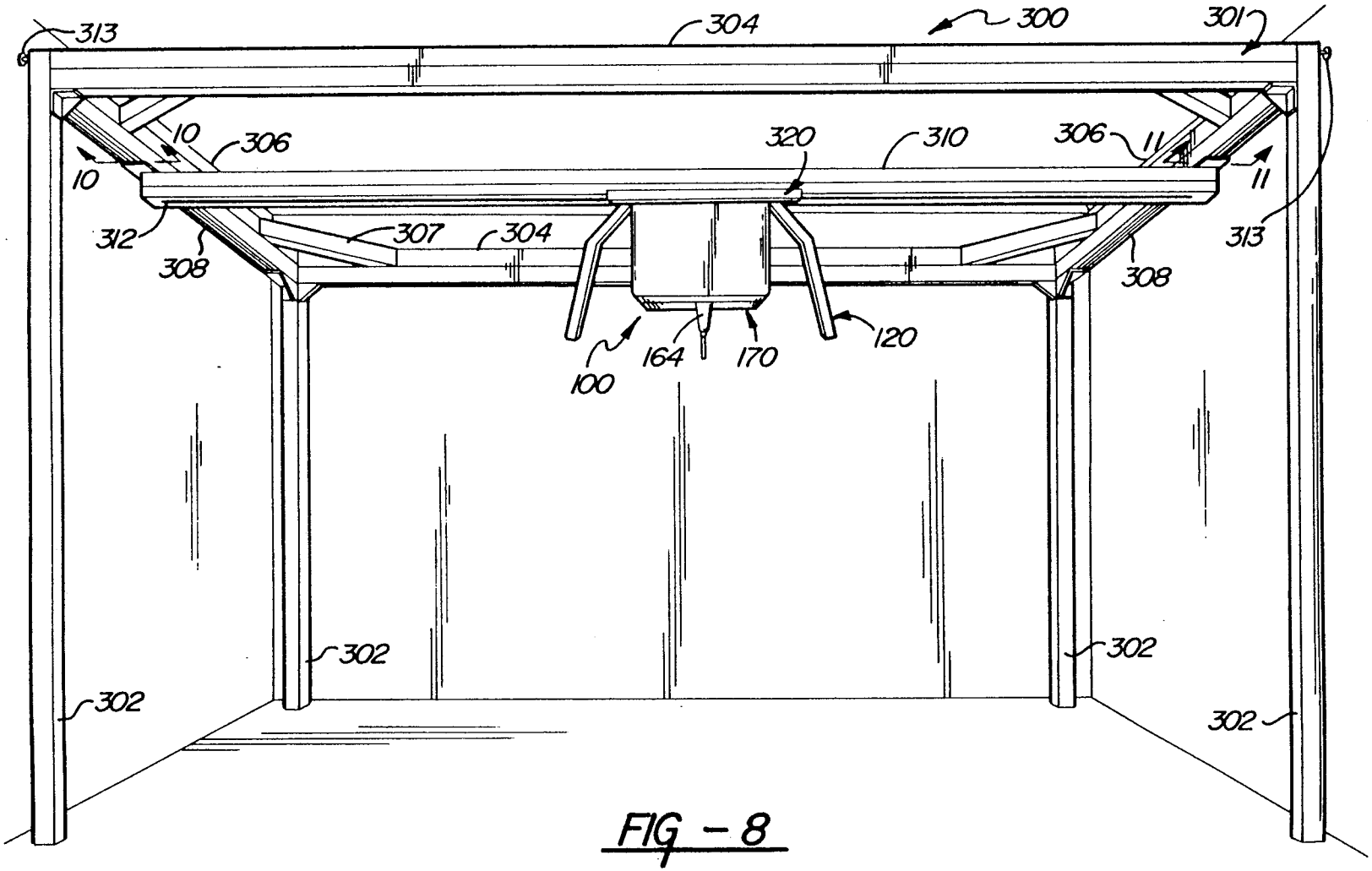
FIG. 8 is a perspective view of the fixed support structure including the hoist assembly.

The cantilevered portion 220 includes a spine 222, a rib 224 and a pulley 226. The spine 222 runs longitudinally down the middle of the cantilevered portion 220. The rib 224 crosses the spine 222. A pulley 226 attaches underneath the spine portion 222 toward the end of the cantilevered portion 220 as shown in FIGS. 6 and 7.

The portable support structure 200 further includes a truss portion 230. The truss portion comprises a transverse reinforcing member 232, two rear wheel brackets 234 and wheels 260. The truss reinforcing member 232 is formed by joining two rigid tubes 233 spaced apart by a spacer 216. The two tubes 233 are welded to the frame 210 toward the bottom of the truss portion 230. The rear wheel brackets 234 attach to the frame 210 on either side of the lower truss portion 230. The wheels 260 engage the floor or ground and support the frame 210 thereabove.

The support bracket 250 mounts to the frame 210 toward the top of the truss portion 230 and toward the back of the cantilevered portion 220. The support bracket 250 helps support the load borne by the cantilevered portion 220.

The base portion 240 includes legs 242, wheel brackets 244, wheels 260 and a reinforcing member 246. The frame 210 at the base portion 240 forms the legs 242. The legs 242 define a space into which a wheel chair may fit. A base reinforcing member 246 may be formed by joining two tubes 247 spaced apart by a spacer 216. The reinforcing member 246 is welded to both of the legs toward the back of the base toward the truss portion 230. Wheel brackets 244 may be attached to the ends of each of the legs 242 and wheels 260 may be mounted thereon. The wheels 260 engage the floor and support the frame 210 thereabove.

The wheels 260 are generally free swivelling wheels having engagable wheel locks 262 thereon.

The hoist 100 is supported from the spine 222, usually by bolting to the under portion of the spine 222. The hoist housing 170 includes a slit 172 through which the cord 164 may pass on its way to passing over the pulley 226.

The patient chair suspension assembly 10 may alternatively include a fixed support structure 300. The fixed support structure 300 movably supports the hoist 100 above the floor support within a bounded area such that the hoist 100 is moveable to any position within the bounded area.

The fixed support structure 300 includes four vertical legs 302, which support an upper frame generally indicated at 301. The upper frame 301 comprises two parallel transverse beams 304 and two parallel length members 306. Disposed below the parallel length members 306 are parallel track members 308. The parallel track members 308 run along the entire length of the length members 306. The entire structure should be reinforced with reinforcing bars 307. The reinforcing bars 307 may be placed across corners formed by the other members 302,304,306 in the vertical and horizontal planes of the fixed support structure 300. The fixed support structure 301 may be stabilized in a room by including adjustable wall engaging pads 313. The adjustable wall engaging pads 313 are substantially screws having wide heads as pads. The pads 313 extend perpendicularly from the length members 306 and press against opposing walls to stabilize the fixed support structure 313. The tightness of the fit with the walls may be adjusted by screwing the pads 313 in or out of the support structure 313.

Trolley assemblies generally indicated at 320 are disposed in each of the tracks 308. A travelling beam 310 is fastened to the bottom central portion of each of the trolleys 320 so that the travelling beam 310 moves forward and backward in the tracks 308 while remaining parallel to the transverse beams 304.

A track member 312 is disposed beneath the travelling beam 310. The track 312 extends along the entire length of the travelling beam 310. Another trolley 320 rides in the track 312. A hoist 200 suspends from the trolley 320 which rides in the track 312. Handlebars 120 are fixed to the hoist 200 for ease in manipulating the patient chair suspension assembly 10.

A cross-section of the track pieces 308, 312 is shown in FIG. 10. The track 308, 312 is substantially a metal channel track. The track 308,312 includes the lip portions 316 having tops 318 and sides 314.

The trolley 320, as shown in FIG. 11, rides inside the track 308, 312. The detail of the trolley 320 is shown in FIG. 9. The trolley 320 is essentially a narrow plate 321 having roller cars 322 mounted thereon. Each roller car 322 includes a chassis 323 having four wheels 325 mounted thereon. The wheels 325 rotate in pairs on horizontal axes. The wheels 325 are mounted on each chassis 323 so that the wheels are elevated above the plate 321. The two roller cars 122 are mounted on either side of the center of the trolley 320. Two roller bearings 324 are mounted on either end of the trolley 320 with a nut 326 and a bolt (not shown) The roller bearings 324 rotate about the axis through the bolt 326 and perpendicular to the length of the trolley 320. The trolley 320 rides in the track 308, 312 in such a manner that the lower part of the wheels 325 contact the top 318 of the lip portion 316 of the track 308, 312, and the roller bearings 324 contact the sides 314 of the lip portion 316.

In operation, the support structure 300 serves to suspend the patient in the chair portions 30,40,50 for easy movement within the space defined by the support structure 300. At first, the patient may be lifted with the hoist 100 from a position somewhere in the space defined by the fixed support structure 300. The operator may then use the handlebars to move the trolley 320 laterally in the track 312, or he may move the entire travelling beam 310 forward or back in the tracks 308. Once the desired position is selected, the patient may be lowered again with the hoist 100.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A patient chair suspension assembly (10) for integrally supporting the back, buttocks and legs of a patient during suspension of the patient, said patient chair suspension assembly comprising:

a rigid back portion (30) having a length and a width;

a rigid seat portion (40) having a length and a width, said seat portion (40) hingedly connected with a first hinge (60) to said back portion (30);

a rigid leg portion (50) having a length and a width, said leg portion hingedly connected with a second hinge (61) to said seat portion (40);

said chair portions (30,40,50) being movably relative to one another between a supine position with sid chair portions aligned and planar, and a reclining position with said leg and seat portions being generally horizontal and said back portion extending upwardly and rearwardly from said seat portion;

said patient chair suspension assembly (10) characterized by suspending support means (12) extending from a support structure to each of said respective chair portions (30,40,50) for solely and independently stabilizing said chair portions in said reclining position while suspending said chair portions from the support structure.

2. A patient chair suspension assembly (10) including as set forth in claim 1 further characterized by including stop means (68) located on said second hinge (61) between said seat (40) and leg (50) portions for limiting pivoting movement of said leg portion (50) about said second hinge (61) relative to said seat portion (40).

3. A patient chair suspension assembly (10) as set forth in claim 1 further characterized by said suspending support means (12) comprising ties (14,16,17,18) for suspending from said support structure and for connecting to each of said chair portions (30,40,50).

4. A patient chair suspension assembly (10) as set forth in claim 3 further characterized by said first and second hinges (60 and 61) for connecting said back, seat and leg portions being integral hinges.

5. A patient chair suspension assembly (10) as set forth in claim 3 further characterized by comprising at least three pairs of said suspending ties (14,16,17,18) suspended by their first ends downward under the force of gravity to their second ends from said support structure, each of said pairs having a predetermined length.

6. A patient chair suspension assembly (10) as set forth in claim 3 further characterized by a first tie pair (14) suspended from said support structure and attached to said back portion (30).

7. A patient chair suspension assembly (10) as set forth in claim 6 further characterized by second and third tie pairs (16,17) suspended from said support structure and attached at spaced positions to said seat portion (40), with said second tie pair (16) disposed between said third tie pair (17) and said first hinge (60).

8. A patient chair suspension assembly (10) as set forth in claim 6 further characterized by a fourth tie pair (18) suspended from said support structure and attached to said leg portion (50).

9. A patient chair suspension assembly as set forth in claim 8 further characterized by said predetermined length of said fourth tie pair (18) being greater than said predetermined length of said second tie pair (16); said second tie pair (16) having said predetermined length greater than said predetermined length of said third tie pair (17); and said third tie pair (17) having said predetermined length greater than said predetermined length of said first tie pair (14).

10. A patient chair suspension assembly (10) as set forth in claim 8 further characterized by said fourth pair of tie straps (18) being crossed between said leg portion (50) and said support structure to provide stability for said chair portions (30,40,50) while said portions are suspended.

11. A patient chair suspension assembly (10) as set forth in claim 10 further characterized by each of said chair portions (30,40,50) having a seating surface (79) defined by an edge (89) and a side surface (99) extending below the edge of said seating surface.

12. A patient chair suspension assembly (10) as set forth in claim 11 further characterized by including chair attachment means (70) located on said side surfaces (99) of said chair portions (30,40,50) for attachment to said ties (14,16,17,18).

13. A patient chair suspension assembly (10) as set forth in claim 12 further characterized by each tie in the pairs (14,16,17,18) including a clip (20) at its second end for attachment to said chair attachment means (70) on said side surfaces (99) of said chair portions (30,40,50).

14. A patient chair suspension assembly (10) as set forth in claim 12 further characterized by said chair attachment means (70) including rings (72) extending from said side surfaces (99) of said chair portions (30,40,50).

15. A patient chair suspension assembly (10) as set forth in claim 14 further characterized by said chair attachment means (70) including at least four pairs of rings (72) to receive said four pairs of suspending ties (14,16,17,18), where one pair of rings (72) is located on said back portion (30), two pairs of rings (72) are located on said seat portion (40) and one pair of rings (72) is located on said leg portion (50).

16. A patient chair suspension assembly (10) as set forth in claim 15 further characterized by said side surfaces (99) of said chair portions (30,40,50) having slits (74) therein and said rings (72) being arranged in pairs with one ring located on one side surface (99) of a chair portion (14,16,17,18) and the second ring located on the opposite side surface of the same chair portion, said pair of rings (72) joined by a connecting tie (76) having a length equal to said width of the chair portion (14,16,17,18), running under said seating surface (79) of said chair portion through said side surface (99) of said chair portion, and passing through said slits (74) in the opposite side surfaces of said chair portion.

17. A patient chair suspension assembly (10) as set forth in claim 16 further characterized by including hook and loop fastener strips (78) under said seating surfaces (79) of said chair portions (30,40,50) for securing said connecting ties (76) to said chair portions.

18. A patient chair suspension assembly (10) as set forth in claim 17 further characterized by said first and second hinges (60 and 61) comprising interleaved fingers 62,64 pivotally interconnected by a rod 66 disposed through said fingers.

19. A patient chair suspension assembly (10) as set forth in claim 18 further characterized by including a stabilizing bar (80) for supporting said suspending ties (14,16,17,18) and for attaching to a support structure.

20. A patient chair suspension assembly (10) as set forth in claim 19 further characterized by said chair stabilizing bar (80) having first and second ends, said chair stabilizing bar (80) adapted for suspension from above so that the length of said bar (80) is parallel to the ground, said chair stabilizing bar (80) including means for suspending said suspending ties (14,16,17,18) from said first and second ends thereof.

21. A patient chair suspension assembly (10) as set forth in claim 19 further characterized by said chair stabilizing bar (80) having generally vertical slots (82) in both ends of the chair stabilizing bar (80) and metal rings (84) suspending downwardly from said slots (82) for attachment to said chair suspending ties (14,16,17,18).

22. A patient chair suspension assembly (10) as set forth in claim 21 further characterized by including a commode hole (90) disposed in said seat portion (40).

23. A patient chair suspension assembly (10) as set forth in claim 22 further characterized by including a commode cover (92) for covering said commode hole (90).

24. A patient chair suspension assembly (10) as set forth in claim 23 further characterized by including cushion means (96) for attachment to said seating surfaces (79) of the chair portions (30,40,50).

25. A patient chair suspension assembly (10) as set forth in claim 24 further characterized by said cushion means (96) comprising a sheep skin.

26. A patient chair suspension assembly (10) as set forth in claim 25 further characterized by including hook and loop fastener means (98) disposed on said seating surfaces (79) of the chair portions (30,40,50) for attaching said sheepskin (96) to said chair portions.

27. A patient chair suspension assembly (10) as set forth in claim 26 further characterized by said chair portions (30,40,50) being made from fiberglass.

28. A patient chair suspension assembly (10) as set forth in claim 19 further characterized by including a hoist (100) for raising and lowering said patient chair suspension assembly.

29. A patient chair suspension assembly (10) as set forth in claim 28 further characterized by said chair stabilizing bar (80) being suspended from said hoist (100).

30. A patient chair suspension assembly (10) as set forth in claim 28 further characterized by including a fixed support structure (300) for moveably supporting said hoist (100) above a floor support within a bounded area such that said hoist is moveable to any position within said bounded area.

31. A patient chair suspension assembly as set forth in claim 28 further characterized by including a portable support structure (200) for supporting said hoist (100) above a floor support, said support structure (200) including roller means for rotatably engaging the floor support to allow movement of said portable support structure (200) of said hoist along said floor support.

* * * * *